US005353087A

United States Patent [19]

Rosenburgh et al.

[11] Patent Number: 5,353,087

[45] Date of Patent: Oct. 4, 1994

[54] AUTOMATIC REPLENISHMENT, CALIBRATION AND METERING SYSTEM FOR AN AUTOMATIC TRAY PROCESSOR

[75] Inventors: John H. Rosenburgh, Hilton; Robert L. Horton, Rochester; David L. Patton, Webster, all of N.Y.

[73] Assignee: Eastman Kodak Company, Rochester, N.Y.

[21] Appl. No.: 56,730

[22] Filed: May 3, 1993

[51] Int. Cl.[5] ..... G03D 3/02

[52] U.S. Cl. ..... 354/324; 354/331; 354/336

[58] Field of Search ..... 354/318–324, 354/331, 336, 298; 134/64 P, 64 R, 122 P, 122 R; 137/624; 430/30, 393, 398, 399

[56] References Cited

U.S. PATENT DOCUMENTS

| | | | |
|---|---|---|---|
| Re. 30,123 | 10/1979 | Crowell | 137/624 |
| Re. 31,484 | 1/1984 | Melander | 354/324 |
| 3,529,529 | 9/1970 | Schumacher | 95/89 |
| 3,554,107 | 1/1971 | McCarthy | 95/89 |
| 3,787,689 | 1/1974 | Fidelman | 250/219 |
| 3,822,723 | 7/1974 | Crowell | 137/624 |
| 3,990,088 | 11/1976 | Takita | 354/298 |
| 4,128,325 | 12/1978 | Melander | 354/298 |
| 4,134,663 | 1/1979 | Laar | 354/298 |
| 4,231,723 | 11/1980 | Spuhl | 417/429 |
| 4,293,211 | 10/1981 | Kaufmann | 354/298 |
| 4,314,753 | 2/1982 | Kaufmann | 354/321 |
| 4,372,665 | 2/1083 | Kaufmann | 354/298 |
| 4,466,072 | 8/1984 | Kaufmann | 364/502 |
| 4,577,950 | 3/1986 | Mackson | 354/324 |
| 4,603,956 | 8/1986 | Baker | 354/298 |
| 4,769,662 | 9/1988 | Suzuki | 354/324 |
| 4,905,161 | 2/1990 | Miller | 364/510 |
| 4,961,516 | 10/1990 | Nakamura | 222/94 |
| 4,977,067 | 12/1990 | Yoshikawa | 430/398 |
| 4,985,320 | 1/1991 | Griffin | 430/30 |
| 4,987,438 | 1/1991 | Goto et al. | 354/319 |
| 4,999,660 | 3/1991 | Wright | 354/324 |
| 5,025,279 | 6/1991 | Ellsworth | 354/298 |
| 5,053,796 | 10/1991 | Ohba | 354/322 |

*Primary Examiner*—D. Rutledge
*Attorney, Agent, or Firm*—Frank Pincelli

[57] ABSTRACT

A low volume photographic material processing apparatus that utilizes a narrow horizontal processing channel with an upturned entrance and exit to contain processing solution within the channel. A replenishment pump calibration system is integrated into the processor so that no manual measurements or special tools are required to set replenishment solution rates.

15 Claims, 6 Drawing Sheets

AUTOMATIC REPLENISHMENT, CALIBRATION AND METERING SYSTEM FOR AN AUTOMATIC TRAY PROCESSOR

CROSS REFERENCE TO RELATED APPLICATIONS

Reference is made to commonly assigned copending patent applications: Ser. No. 08/057,250, filed May 3, 1993, entitled "AUTOMATIC TRAY PROCESSOR" in the names of John H. Rosenburgh, Joseph A. Manico, David L. Patton and Ralph L. Piccinino, Jr., and Ser. No. 08/056,458, filed May 3, 1993, entitled "MODULAR PROCESSING CHANNEL FOR AN AUTOMATIC TRAY PROCESSOR" in the names of Joseph A. Manico, Ralph L. Piccinino, Jr., David L. Patton and John H. Rosenburgh, and Ser. No. 08/056,477, filed May 3, 1993, entitled "COUNTER CROSS FLOW FOR AN AUTOMATIC TRAY PROCESSOR" in the names of John H. Rosenburgh, Ralph L. Piccinino, Jr., David L. Patton and Joseph A. Manico, and Ser. No. 08/057,131, filed May 3, 1993, entitled "VERTICAL AND HORIZONTAL POSITIONING AND COUPLING OF AUTOMATIC TRAY PROCESSOR CELLS" in the names of David L. Patton, Joseph A. Manico, John H. Rosenburgh and Ralph L. Piccinino, Jr., and Ser. No. 08/056,451, filed May 3, 1993, entitled "TEXTURED SURFACE WITH CANTED CHANNELS FOR AN AUTOMATIC TRAY PROCESSOR" in the names of Ralph L. Piccinino, Jr., John H. Rosenburgh, David L. Patton and Joseph A. Manico, and Ser. No. 08/056,457, filed May 3, 1993, entitled "CLOSED SOLUTION RECIRCULATION/SHUTOFF SYSTEM FOR AN AUTOMATIC TRAY PROCESSOR" in the names of John H. Rosenburgh, Joseph A. Manico, Ralph L. Piccinino, Jr. and David L. Patton, and Ser. No. 08/056,649, filed May 3, 1993, entitled "A SLOT IMPINGEMENT FOR AN AUTOMATIC TRAY PROCESSOR" in the names of John H. Rosenburgh, David L. Patton, Joseph A. Manico and Ralph L. Piccinino, Jr., and Ser. No. 08/056,455, filed May 3, 1993, entitled "AUTOMATIC REPLENISHMENT, CALIBRATION AND METERING SYSTEM FOR A PHOTOGRAPHIC PROCESSING APPARATUS" in the names of John H. Rosenburgh, Robert L. Horton and David L. Patton.

FIELD OF THE INVENTION

The invention relates to the field of photography, and particularly to a photosensitive material processing apparatus.

BACKGROUND OF THE INVENTION

The processing of photosensitive material involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

The chemicals contained in the processing solution: cost money to purchase; change in activity and are seasoned by the constituents of the photosensitive material that leach out during the photographic process; and after the chemicals are used the chemicals must be disposed of in an environmentally safe manner. Thus, it is important in all sizes of photofinishing apparatus to reduce the volume of processing solution. The prior arts suggest various types of replenishing systems that add or subtract specific chemicals to the processing solution to maintain a consistency of photographic characteristics in the material developed. Photosensitive material processing equipment typically consists of several large volume tanks of processing solution that the exposed photosensitive material is driven or towed through to produce an image, as the photosensitive material is processed the strength of the processing solutions is diminished and will eventually become exhausted. To prevent the continual weakening of the processing solution additional fresh processing solution is added to the tank solution at a rate equivalent to the rate of use and rate of carry out of the processing solution. The above maintains processing solution activity and volume. Typically the replenish is very small compared to the working processing tank volume. A typical ratio of replenishment per square foot of photosensitive material for a large volume tank would be 0.00025 to 0.00075 of the tank volume. Since the above ratio is small the effect of pulsing delivery and cyclic variation of the replenishment delivery by 5 or 10% over time, does not have an immediate significant effect on the processing solution.

Typical replenishment is accomplished by using a single standard bellow pump (like Gorman-Rupp single bellow metering pump mode number 13300-007). When replenishment is required the pump is turned on/off through known means and the replenishment solution is pumped in "doses" or "squirts" usually into the top of the main processing tank in close proximity to the recirculation system. As the bellows pump delivers solution to the top of the tank, the bellows pump is not experiencing any variable back pressure or head. As the replenishment in the large tank occurs, the pressure is only that of line restriction and gravity from the replenishment storage tanks to the solution delivery location. The pulsing delivery is acceptable as the ratio of replenishment to tank solution is very small. The above pump works well for large volume tanks, because the large volume of solution acts as a ballast.

Replenishment calibration is typically a manual operation involving running the replenishment pump and measuring the solution output volume. This measuring device used is most often a graduated cylinder. The measured amount of solution is compared to the chemical manufacturers' specification for the type of photosensitive material and amount of replenishment solution required to be added.

Successive timed measurements of replenishment solution delivery are made to determine the actual replenishment solution delivery rate. If adjustments are required, a manual adjustment of the bellows pump is made. Following the adjustment, the delivery of replenishment solution is again measured, and further adjustments are made until the delivery of replenishment solution is consistently at the required amount. During the above adjustment time the processor can not be used to process photosensitive materials. Thus, the processor would not be processing photosensitive materials when the pumps are being calibrated.

PROBLEMS TO BE SOLVED BY THE INVENTION

The prior art utilized a manual time consuming procedure, which required an experienced operator to measure the replenishment delivery amounts prior to and following each calibration and adjustment of the replenishment pumps.

Typically the calibration and adjustment of the pumps can take 30 minutes to 4 hours. Furthermore, the calibration and adjustments are subject to human error. If the accuracy of the processor is not maintained then the processor will not produce products having consistent quality.

As the tank volumes are reduced, the ratio of replenisher delivery to tank volume significantly increased for example by a factor of 10 for a tank one tenth the volume of a standard 20 liter tank. Because the tank volume is small, the "pulse" or "squirt" delivery of the bellows pump has a greater impact on the tank solution consistency. This pulsing delivery creates pulsing or cyclic activity increases and decreases in the processor as its volume percentage is greater in the lower volume tank.

The consistency of replenishment solution delivery is also more critical in smaller processing volumes.

Another problem in the prior art is that when the pumps are turned on the rotational position of the pump varies. Similarly when the pumps are turned off the pump drive motor coasts stopping rotation at a unknown position. The above causes a variation of replenishment solution delivery over a constant time interval when the pumps are activated.

SUMMARY OF THE INVENTION

This invention overcomes the disadvantages of the prior art by providing a replenishment pump calibration system that is integrated into the processor so that no manual measurement or special tools are required to set replenishment solution rates. As this is an integrated operation it can be done very quickly and accurately without requiring an experienced operator and excessive down time.

By combining two or more bellows pumps together in parallel and equally offsetting the replenishment solution delivery cycle of each bellows pump, the "pulsing" may be smoothed to a more consistent solution delivery rate per rotation of the pump drive motor. A stepper motor may be used to drive the bellows pumps. Small delivery changes may be made by simply changing the stepper motor drive frequency. The pump drive frequency is directly proportional to the replenishment solution delivered. This allows the start and stop rotational position of the bellows pumps to be known. By combing the aforementioned bellows pumps and stepper motor with a constant metering vessel and control system automatic replenishment calibration may be achieved.

The foregoing is accomplished by providing an apparatus for processing photosensitive materials, which comprises: a container which contains a channel through which a processing solution flows, the entrance and exit of the channel are upturned to contain processing solution within the channel; means coupled to the channel for transporting the photosensitive material from the channel entrance, through the channel, to the channel exit, the channel and the means are relatively dimensioned so that a small volume for holding processing solution and photosensitive material is formed between the channel and said means; means for circulating the processing solution through the small volume and the container; and means for replenishing the processing solution in precisely controlled volumes, in order to uniformly distribute the replenished processing solution to the circulating means.

ADVANTAGEOUS EFFECT OF THE INVENTION

The above arrangement, provides a method for accurately replenishing processing solution through a low volume photographic material processing apparatus.

This invention also permits start up and shut down of the replenishment pumps, while allowing the processor to produce products having consistent quality.

Another advantage of this invention is that the calibration of the replenishment pumps requires minimal human intervention. Thus, reducing operation error.

An additional advantage of the replenishment system is that the photographic processor may remain in operation while the replenishment system is being calibrated, checked or different solution replenishment rates are implemented.

DESCRIPTION OF THE PREFERRED EMBODIMENT

Figure 1:
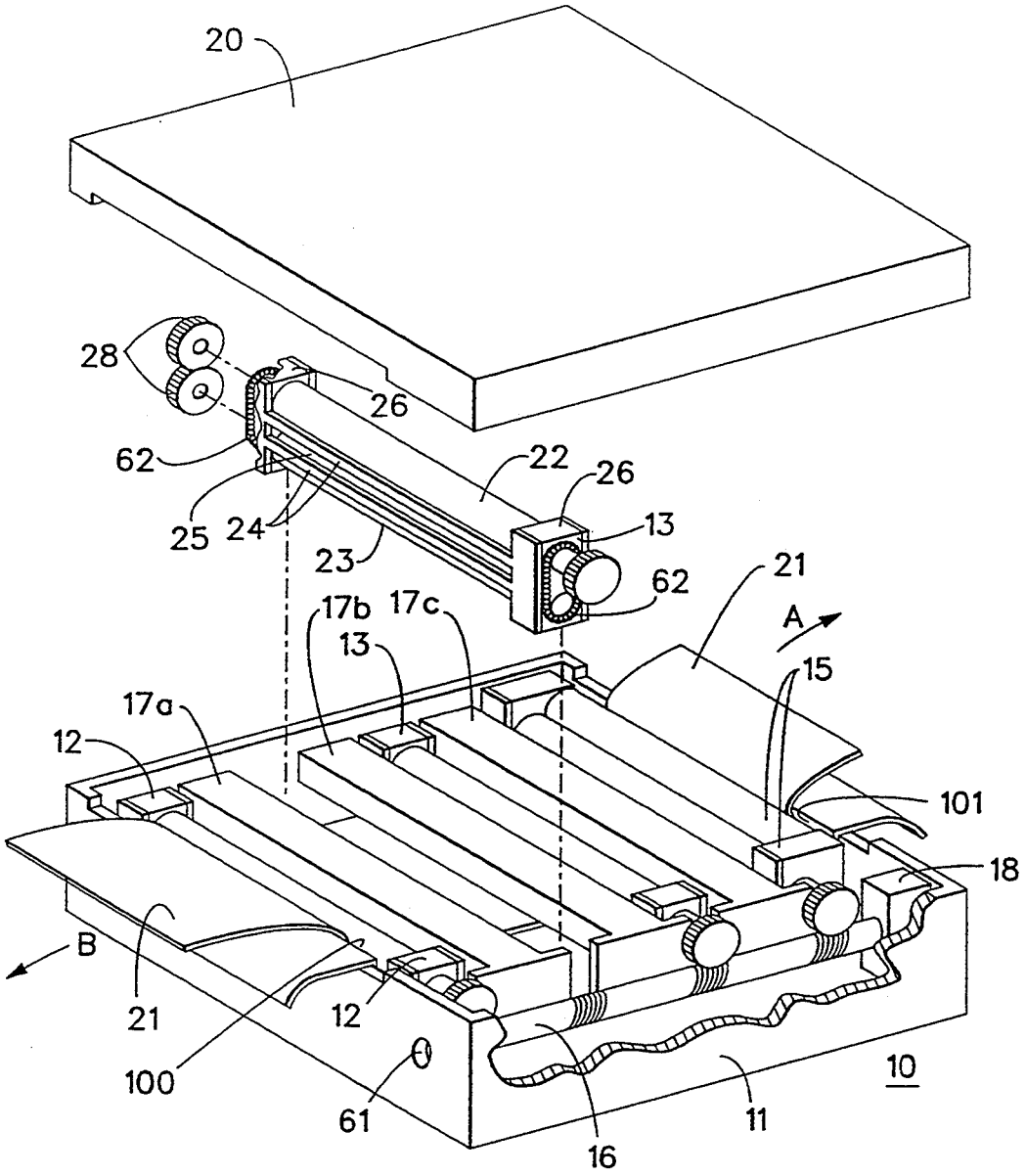
FIG. 1 is a perspective drawing of module 10.

Referring now to the drawings in detail, and more particularly to FIG. 1, the reference character 10 represents a processing module, which may stand alone or be easily combined or adjoined with other processing modules 10 to form a continuous low volume unit for processing photosensitive materials.

Processing module 10 includes: a container 11; an upturned entrance channel 100 (described in the description of FIG. 2); an entry transport roller assembly 12; transport roller assemblies 13; an exit transport roller assembly 15; an upturned exit channel 101 (described in the description of FIG. 2); high impingement slot nozzles 17*a*, 17*b* and 17*c*; a drive 16 and a rotating assembly 18, assembly 18 may be any known means for turning drive 16, i.e., a motor, a gear, a belt, a chain, etc. An access hole 61 is provided in container 11. Hole 61 is utilized for the interconnection of modules 10. Assemblies 12, 13 and 15 are positioned within container 11 in the vicinity of the walls of container 11 and slot nozzles 17*a*, 17*b* and 17*c* are positioned within the vicinity of the walls of container 11. Drive 16 is connected to roller assemblies 12, 13 and 15 and turning assembly 18 and assembly 16 is used to transmit the motion of assembly 18 to assemblies 12, 13 and 15.

Roller assemblies 12, 13, and 15, and slot nozzles 17*a*, 17*b* and 17*c* may be easily inserted into or removed from container 11. Roller assembly 13 includes: a top roller 22; a bottom roller 23; tension springs 62, which holds top roller 22 in compression with respect to bottom roller 23; a bearing bracket 26; and a channel section 24. A narrow channel opening 25 exists within section 24. Opening 25 on the entrance side of section 24 may be the same size and shape as opening 25 on the exit side of section 24. Opening 25 on the entrance side of section 24 may also be relieved, tapered or larger than the exit side of section 24 to accommodate rigidity variations of various types of photosensitive material 21. Channel opening 25 forms a portion of processing channel 25. Rollers 22 and 23 may be drive or driven rollers and rollers 22 and 23 are connected to bracket 26. Rollers 22 and 23 are rotated by intermeshing gears 28.

Photosensitive material 21 is transported in either direction A or direction B automatically through processing channel 25 by roller assemblies 12, 13 and 15. Photosensitive material 21 may be in a cut sheet or roll format or photosensitive material 21 may be simultaneously in a roll and simultaneously in a cut sheet format. Photosensitive material 21 may contain an emulsion on either or both of its surfaces.

When cover 20 is placed on container 11 a light tight enclosure is formed. Thus, module 10 with its associated recirculation system 60, which is described in the description of FIG. 5, will be a stand alone light tight module that is capable of processing photosensitive material, i.e., a monobath. When two or more modules 10 are combined a multi-stage continuous processing unit may be formed. The combination of one or more modules 10 will be more fully set forth in the description of FIG. 6.

Figure 2:
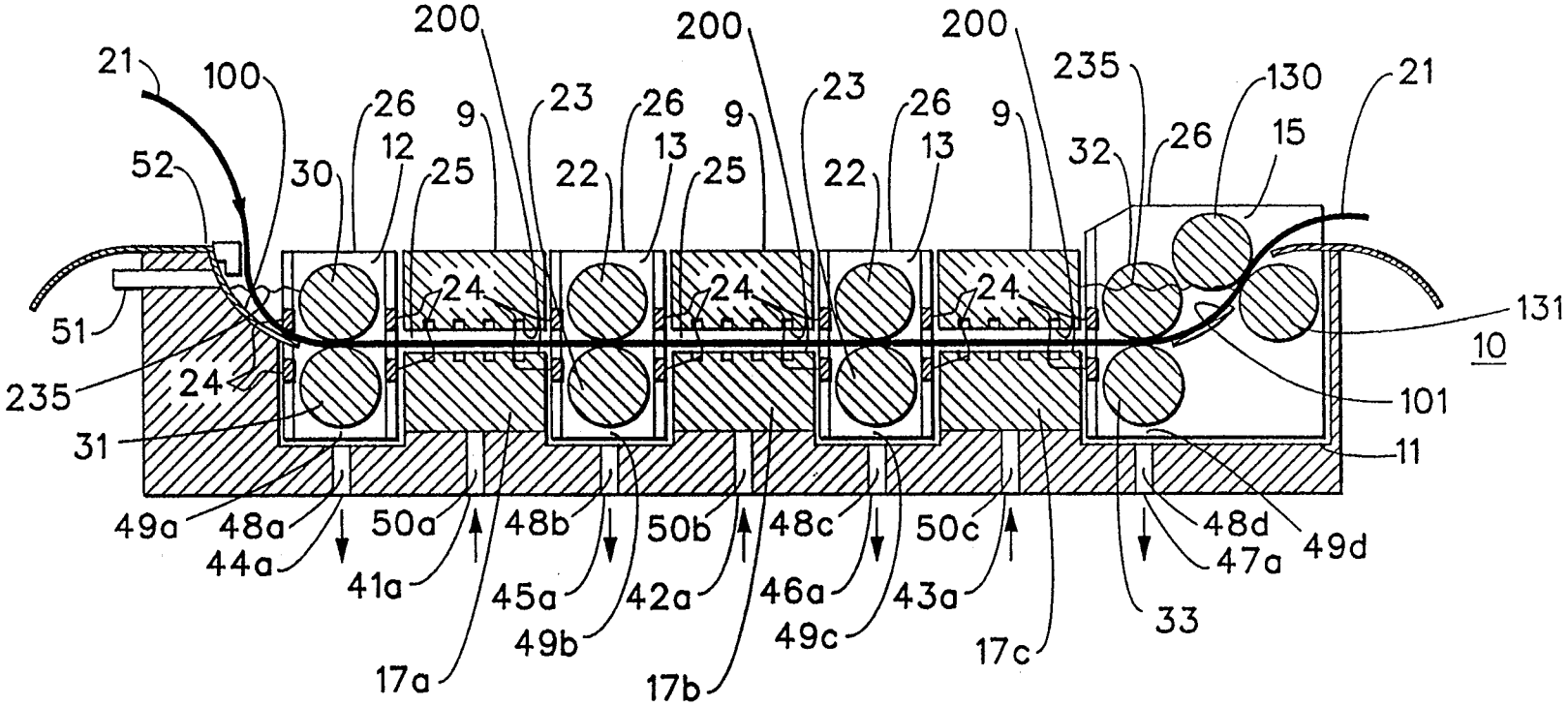
FIG. 2 is a partially cut away drawing of module 10 in which material 21 has an emulsion on one surface and nozzles 17*a*, 17*b* and 17*c* are on the bottom portion of container 11 facing the emulsion surface of material 21.

FIG. 2 is a partially cut away section of module 10 of FIG. 1. Assemblies 12, 13 and 15, nozzles 17*a*, 17*b* and 17*c* and backing plate 9 are designed in a manner to minimize the amount of processing solution that is contained in processing channel 25, vessel 11, recirculation system 60 (FIG. 5) and gaps 49*a*, 49*b*, 49*c* and 49*d*. At the entrance of module 10, an upturned channel 100 forms the entrance to processing channel 25. At the exit of module 10, a upturned channel 101 forms the exit to processing channel 25. Assembly 12 is similar to assembly 13. Assembly 12 includes: a top roller 30; a bottom roller 31; tension springs 62 (not shown) which holds top roller 30 to bottom roller 31; a bearing bracket 26; and a channel section 24. A portion of narrow processing channel 25 is formed by channel section 24. Rollers 30 and 31 may be drive or driven rollers and rollers 30 and 31 are connected to bracket 26. Assembly 15 is similar to assembly 13, except that assembly 15 has an additional two rollers 130 and 131, which operate in the same manner as rollers 32 and 33. Assembly 15 includes: a top roller 32; a bottom roller 33; tension springs 62 (not shown); a top roller 130; a bottom roller 131; a bearing bracket 26; and a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26.

Backing plate 9 and slot nozzles 17*a*, 17*b* and 17*c* are affixed to container 11. The embodiment shown in FIG. 2 will be used when photosensitive material 21 has an emulsion on one of its surfaces. The emulsion side of material 21 will face slot nozzles 17*a*, 17*b* and 17*c*. Material 21 enters channel 25 between rollers 30 and 31 and moves past backing plate 9 and nozzle 17*a*. Then material 21 moves between rollers 22 and 23 and moves past backing plates 9 and nozzles 17*b* and 17*c*. At this point material 21 will move between rollers 32 and 33, and move between rollers 130 and 131 and exit processing channel 25.

Figure 5:
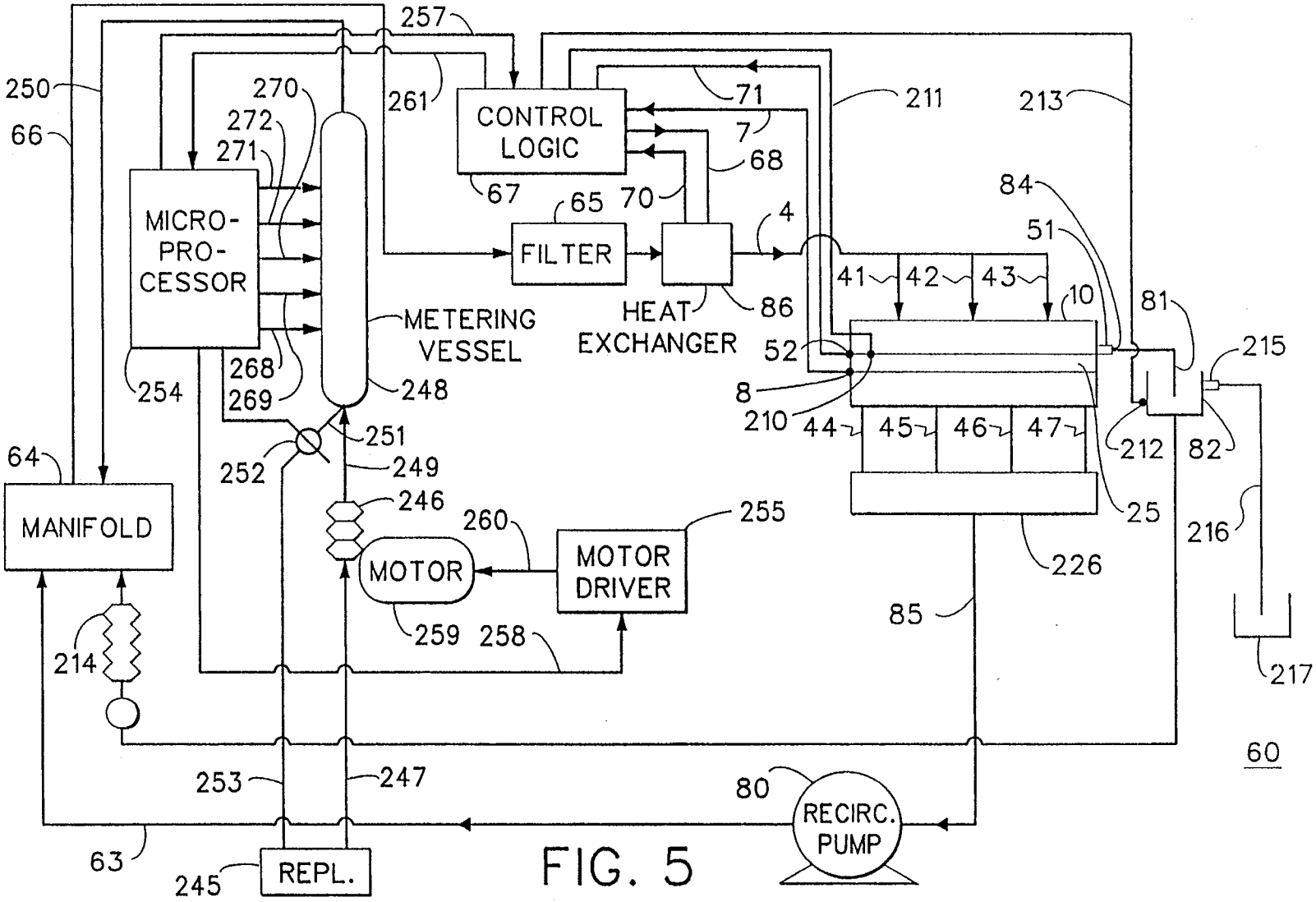
FIG. 5 is a schematic drawing of the processing solution recirculation replenishment and calibration system of the apparatus of this invention.

Conduit 48*a* connects gap 49*a*, via port 44*a* to recirculation system 60 via port 44 (FIG. 5), which is more fully described in the description of FIG. 5, and conduit 48*b* connects gap 49*b*, via port 45*a* to recirculation system 60 via port 45 (FIG. 5). Conduit 48*c* connects gap 49*c*, via port 46*a* to recirculation system 60 via port 46 (FIG. 5) and conduit 48*d* connects gap 49*d*, via port 47*a* to recirculation system 60 via port 47 (FIG. 5). Slot nozzle 17*a* is connected to recirculation system 60 via conduit 50*a* and inlet pork 41*a* via port 44 (FIG. 5) and slot nozzle 17*b* is connected to recirculation system 60 via conduit 50*b* and inlet port 42*a* via inlet port 42 (FIG. 5). Conduit 50*c* connects nozzle 17*c*, via inlet port 43*a* to recirculation system 60 via port 43 (FIG.5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of backing plate 9 that faces processing channel 25 and to the surface of slot nozzles 17*a*, 17*b* and 17*c* that faces processing channel 25.

Figure 3:
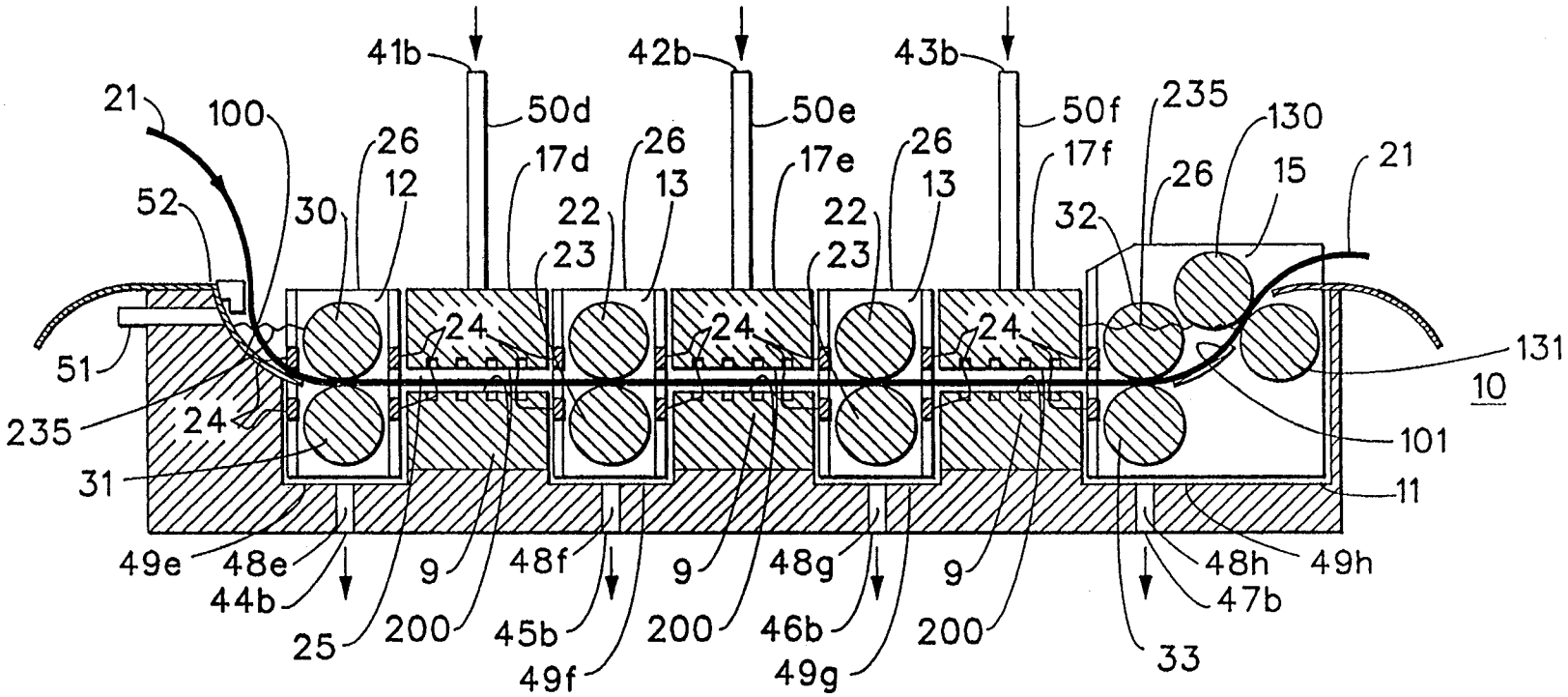
FIG. 3 is a partially cut away drawing of an alternate embodiment of module 10 of FIG. 2 in which material 21 has an emulsion on one surface and nozzles 17*d*, 17*e* and 17*f* are on the top portion of container 11 facing the emulsion surface of material 21.

FIG. 3 is a partially cut away drawing of an alternate embodiment of module 10 of FIG. 2 in which material 21 has an emulsion on one surface and nozzles 17*d*, 17*e* and 17*f* are on the top portion of container 11. Assemblies 12, 13 and 15, nozzles 17*d*, 17*e* and 17*f* and backing plate 9 are designed in a manner to minimize the amount of processing solution that is contained in processing channel 25 and gaps 49*e*, 49*f*, 49*g* and 49*h*. At the entrance of module 10, an upturned channel 100 forms the entrance to processing channel 25. At the exit of module 10, an upturned channel 101 forms the exit to processing channel 25. Assembly 12 is similar to assembly 13. Assembly 12 includes: a top roller 30; a bottom roller 31; tension springs 62 (not shown) which holds top roller 30 in compression with respect to bottom roller 31, a bearing bracket 26; and a channel section 24. A portion of narrow channel opening 25 exists within section 24. Channel section 24 forms a portion of processing channel 25. Rollers 30 and 31 may be drive or driven rollers and rollers 30 and 31 are connected to bracket 26. Assembly 15 is similar to assembly 13, except that assembly 15 has an additional two rollers 130 and 131 which operate in the same manner as rollers 32 and 33. Assembly 15 includes: a top roller 32; a bottom roller 33; a tension spring 62 (not shown); a top roller 130; a bottom roller 131; a bearing bracket 26; and a channel section 24. A portion of narrow processing channel 25 exists within section 24. Channel section 24 forms a portion of processing channel 25. Rollers 32, 33, 130 and 131 may be drive or driven rollers and rollers 32, 33, 130 and 131 are connected to bracket 26.

Backing plate 9 and slot nozzles 17*d*, 17*e* and 17*f* are affixed to container 11. The embodiment shown in FIG. 3 will be used when photosensitive material 21 has an emulsion on one of its surfaces. The emulsion side of material 21 will face slot nozzles 17*d*, 17*e* and 17*f*. Material 21 enters channel 25 between rollers 30 and 31 and moves past backing plate 9 and nozzle 17*d*. Then material 21 moves between rollers 22 and 23 and moves past backing plates 9 and nozzles 17*e* and 17*f*. At this point material 21 will move between rollers 32 and 33 and move between rollers 130 and 131 and exit processing channel 25.

Conduit 48*e* connects gap 49*e*, via port 44*b* to recirculation system 60 via port 44 (FIG.5) and conduit 48*f* connects gap 49*f*, via port 45*b* to recirculation system 60 via port 45 (FIG. 5). Conduit 48*g* connects gap 49*g*, via port 46*b* to recirculation system 60 via port 46 (FIG. 5) and conduit 48*h* connects gap 49*h*, via port 47*b* to recirculation system 60 via port 47 (FIG. 5). Slot nozzle 17*d* is connected to recirculation system 60 via conduit 50*d* and inlet port 41*b* via inlet 41 (FIG. 5) and slot nozzle 17*e* is connected to recirculation system 60 via conduit 50*e* and inlet port 42*b* via port 42 (FIG. 5). Conduit 50*f* connects nozzle 17*f*, via inlet port 43*b* to recirculation system 60 via port 43 (FIG. 5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of backing plate 9 that faces processing channel 25 and to the surface of slot nozzles 17*d*, 17*e* and 17*f* that faces processing channel 25.

Figure 4:
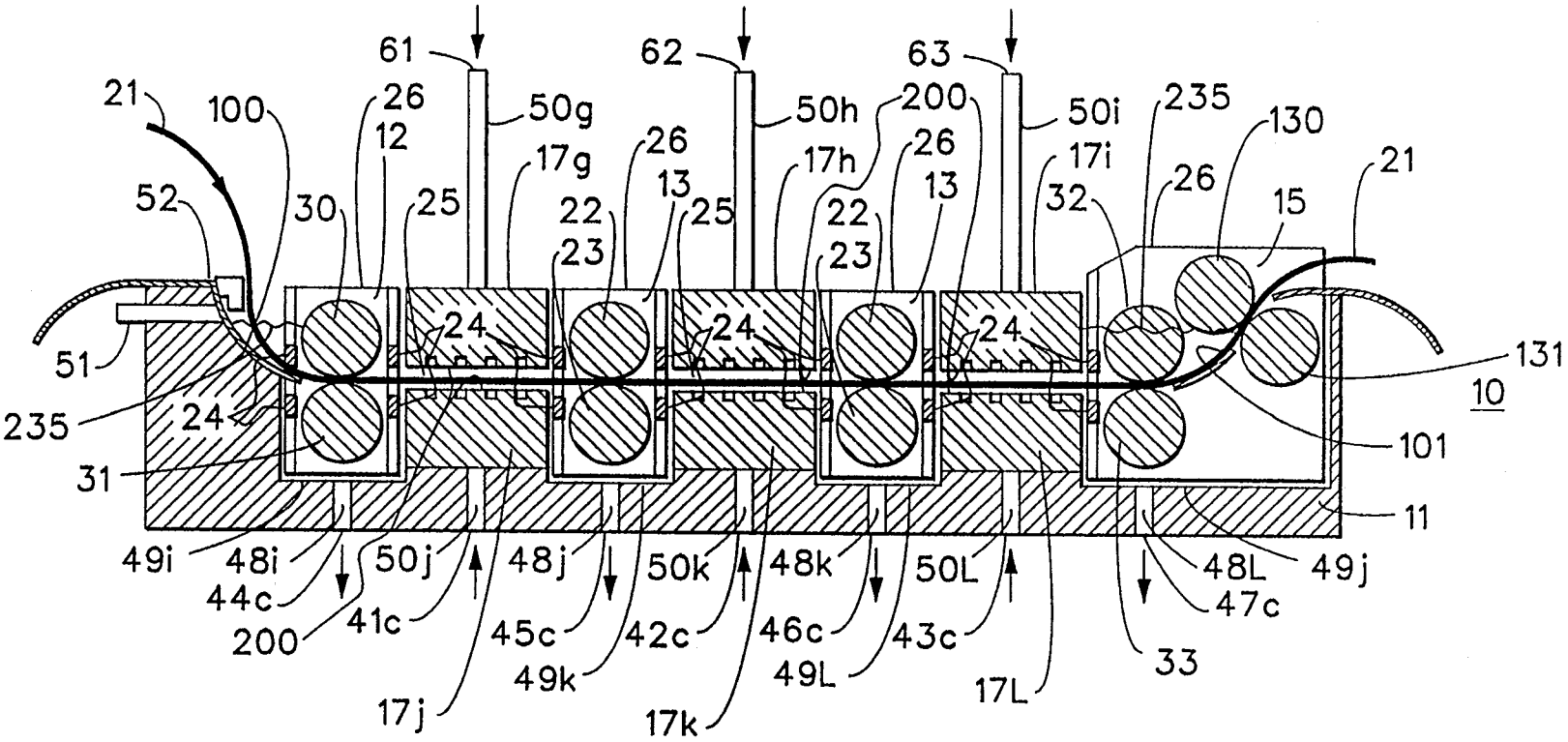
FIG. 4 is a partially cut away drawing of an alternate embodiment of module 10 of FIG. 2 in which material 21 has an emulsion on both surfaces and nozzles 17*g*, 17*h* and 17*i* are on the top portion of container 11 facing one emulsion surface of material 21 and nozzles 17*j*, 17*k*, and 17*L* are on the bottom portion of container 11 facing the other emulsion surface of material 21.

FIG. 4 is a partially cut away drawing of an alternate embodiment of module 10 of FIG. 2 in which material 21 has an emulsion on both surfaces and nozzles 17*g*, 17*h* and 17*i* are on the top portion of container 11 facing one emulsion surface of material 21 and nozzles 17*j*, 17*k*, and 17*L* are on the bottom portion of container 11 facing the other emulsion surface of material 21. Assemblies 12, 13 and 15, nozzles 17*g*, 17*h*, 17*i*, 17*j*, 17*k* and 17*L* are designed in a manner to minimize the amount of processing solution that is contained in processing channel 25 and gaps 49*i*, 49*j*, 49*k* and 49*L*. At the entrance of module 10, a upturned channel 100 forms the entrance to processing channel 25. At the exit of module 10, a upturned channel 101 forms the exit to processing channel 25. Assembly 12 includes: a top roller 30; a bottom roller 31; tension springs 62 (not shown) which holds top roller 30 in compression with respect to bottom roller 31, a bearing bracket 26; and a channel section 24. A portion of narrow processing channel 25 exists within section 24. Channel section 24 forms a portion of processing channel 25. Rollers 30, 31, 130 and 131 may be drive or driven rollers and rollers 30, 31, 130 and 131 are connected to bracket 26. Assembly 15 is similar to assembly 13, except that assembly 15 has an additional two rollers 130 and 131 which operate in the same manner as rollers 32 and 33. Assembly 15 includes: a top roller 32; a bottom roller 33; tension springs 62 (not shown); a top roller 130; a bottom roller 131; a bearing bracket 26; and a channel section 24. A portion of narrow processing channel 25 exits within section 24. Channel section 24 forms a portion of processing channel 25. Rollers 32, 33, 130 and 131 may be drive or driven rollers and rollers 32, 33, 130 and 131 are connected to bracket 26.

Slot nozzles 17*g*, 17*h* and 17*i* are affixed to the upper portion of container 11. Slot nozzles 17*j*, 17*k* and 17*L* are affixed to the lower portion of container 11. The embodiment shown in FIG. 4 will be used when photosensitive material 21 has an emulsion on both of its two surfaces. One emulsion side of material 21 will face slot nozzles 17*g*, 17*h* and 17*i* and the other emulsion side of material 21 will face slot nozzles 17*j*, 17*k* and 17*L*. Material 21 enters channel 25 between rollers 30 and 31 and moves past and nozzles 17*g* and 17*j*. Then material 21 moves between rollers 22 and 23 and moves past nozzles 17*h*, 17*k*, 17*i* and 17*L*. At this point material 21 will move between rollers 32 and 33 and move between rollers 130 and 131 and exit processing channel 25.

Conduit 48*i* connects gap 49*i*, via port 44*c* to recirculation system 60 via port 44 (FIG.5) and conduit 48*j* connects gap 49*k*, via port 45*c* to recirculation system 60 via port 45 (FIG. 5). Conduit 48*k* connects gap 49*L*, via port 46*c* to recirculation system 60 and conduit 48*L* connects gap 49*j*, via port 47*c* to recirculation system 60 via port 47 (FIG. 5). Slot nozzle 17*g* is connected to recirculation system 60 via conduit 50*g* via port 41 (FIG. 5). Slot nozzle 17*h* is connected to recirculation system 60 via conduit 50*h* and inlet port 62 via port 42 (FIG. 5). Conduit 50*i* connects nozzle 17*i*, via inlet port 63 to recirculation system 60 via port 43 (FIG. 5). Slot nozzle 17*j* is connected to recirculation system 60 via conduit 50*j* and inlet port 41*c* via port 41 (FIG. 5) and slot nozzle 17*k* is connected to recirculation system 60 via conduit 50*k* and inlet port 42*c* via port 42 (FIG. 5). Slot nozzle 17*L* is connected to recirculation system 60 via conduit 50*L* and inlet port 43*c* via port 43 (FIG. 5). Sensor 52 is connected to container 11 and sensor 52 is used to maintain a level of processing solution relative to conduit 51. Excess processing solution may be removed by overflow conduit 51. Material 21 enters upturned channel entrance 100, then passes through channel section 24 of channel 25 between rollers 30 and 31 and moves past nozzles 17*g* and 17*j*. Then material 21 moves between rollers 22 and 23 and moves past nozzles 17*h* and 17*k*, 17*L* and 17*i*. At this point material 21 will move between rollers 32 and 33 and exit processing channel 25.

Conduit 48*i* connects gap 49*i* via port 44*c* to recirculation system 60 via port 44 (FIG. 5) and conduit 48*j* connects gap 49*k*, via port 45*c* to recirculation system 60 via port 45 (FIG. 5). Conduit 48*k* connects gap 49*L*, via port 46*c* to recirculation system 60 via port 46 (FIG. 5) and conduit 48*L* connects gap 49*j*, via port 47*c* to recirculation system 60 via port 47 (FIG. 5). Sensor 52 is connected to container 11 and sensor 52 is used to maintain a processing solution level 235 relative to conduit 51. Excess processing solution may be removed by overflow conduit 51.

Textured surface 200 or 205 is affixed to the surface of slot nozzles 17*g*, 17*h*, 17*i*, 17*j*, 17*k* and 17*L* that face processing channel 25.

FIG. 5 is a schematic drawing of the processing solution recirculation replenishment and calibration system of this invention. Module 10 is designed in a manner to minimize the volume of channel 25. The outlets 44, 45, 46 and 47 of module 10 are connected to sump 226. Sump 226 is connected to recirculating pump 80 via conduit 85. Recirculating pump 80 is connected to manifold 64 via conduit 63 and manifold 64 is coupled to filter 65 via conduit 66. Filter 65 is connected to heat exchanger 86 and heat exchanger 86 is connected to channel 25 via conduit 4. Heat exchanger 86 is also connected to control logic 67 via wire 68. Control logic 67 is connected to heat exchanger 86 via wire 70 and sensor 52 is connected to control logic 67 via wire 71. Solution replenishment vessel 245 is connected to metering pump 246 via conduit 247. Metering pump 246 is connected to metering vessel 248 via conduit 249. Metering vessel 248 is connected to manifold 64 via conduit 250. Metering vessel 248 is connected to replenishment vessel 245 via conduit 251, valve 252 and conduit 253. Metering pump 246, metering vessel 248, valve 252 and motor drive 255 are connected to microprocessor 254.

The photographic processing chemicals that comprise the photographic solution are placed in replenishment vessel 245. The desired replenishment rate is entered into control logic 67 by any known means such as manually or scanning the desired information through the control panel of control logic 67. Metering pump 246 and metering vessel 248 are used to place the correct amount of chemicals in manifold 64, when photosensitive material sensor 210 senses that material 21 (FIG. 1) is entering channel 25. Sensor 210 transmits a signal to control logic 67 via line 211. Control logic 67 sends a signal via wire 257 to microprocessor 254. Microprocessor 254 transmits a signal via wire 258 to motor driver 255. Motor driver 255 is the B & B Motor and Control Corp. gear motor driver No. CP-10PN-4 and motor 259 is the B & B Motor and Control Corp., motor model No. BV6G-60. B & B Motors and Control Corp. is located at Apple Hill Commons, Burlington, CT 06013. Microprocessor 254 is the Intel 8051 Microcontroller manufactured by Intel Corp. of 3065 Bowers Avenue, Santa Clara, CA 95051. Motor driver 255 transmits a signal to motor 259 via wire 260. Motor 259 may be a stepper motor or a motor that may be controlled to variable speeds. The above signal energizes motor 259 which causes replenishment solution to be pumped from replenishment vessel 245 through conduit 247 into pump 246. Pump 246 is a single bellows with 360° variable rotational speed whose speed can be varied during the 360° rotational to provide smooth nonpulsing solution output or pump 246 is a combination of two or more bellows that are connected together equally out of rotational phase with their input and output lines connected in parallel so that the solution delivery is smoothed to a more consistent solution delivery rate per rotation of the pump drive motor. Pump 246 pumps solution through conduit 249 into metering vessel 248. Thereupon the replenishment solution moves through conduit 250 into manifold 64. At start up of module 10 or when replenishment calibration is initiated valve 252 is opened which drains the contents of metering vessel 248 through conduit 253 into replenisher vessel 245. Valve 252 is then closed, microprocessor 254 signals motor driver 255 which starts motor 259 at a constant rate driving pump 246. Replenisher solution is pumped from replenisher vessel 245 via conduit 247 into metering vessel 248 via conduit 249 by pump 246. As the solution is pumped through metering vessel 248 it passes sensors 268, 269, 270, 271 and 272. Sensors 268–272 are used to sense the rate of solution flow through metering vessel 248. As metering vessel 248 is a constant volume vessel the replenishment rate may be determined by microprocessor 254.

The rate measured by sensors 268–272 is compared to the desired replenishment rate inputted into control logic 67 and transmitted to microprocessor 254. Microprocessor 254 signals motor driver 255 to speed up or slow down motor 259 as required to meet replenishment rate requirements. Manifold 64 introduces the photographic processing solution into conduit 66.

The photographic processing solution flows into filter 65 via conduit 66. Filter 65 removes contaminants and debris that may be contained in the photographic processing solution. After the photographic processing solution has been filtered, the solution enters heat exchanger 86.

Sensor 52 senses the solution level and sensor 8 senses the temperature of the solution and respectively transmits the solution level and temperature of the solution to control logic 67 via wires 71 and 7. For example, control logic 67 contains the series CN 310 solid state temperature controller manufactured by Omega Engineering, Inc. of 1 Omega Drive, Stamford, Conn. 06907 and Intel 8051 Microcontrollers Logic 67 compares the solution temperature sensed by sensor 8 and the temperature that exchanger 86 transmitted to logic 67 via wire 70. Logic 67 will inform exchanger 86 to add or remove heat from the solution. Thus, logic 67 and heat exchanger 86 modify the temperature of the solution and maintain the solution temperature at the desired level.

Sensor 52 senses the solution level in channel 25 and transmits the sensed solution level to control logic 67 via wire 71. Logic 67 compares the solution level sensed by sensor 52 via wire 71 to the solution level set in logic 67. Logic 67 will inform microprocessor 254 via wire 261 to add additional solution if the solution level is low. Once the solution level is at the desired set point control logic 67 will inform microprocessor 254 to stop adding additional solution.

Any excess solution may either be pumped out of module 10 or removed through level drain overflow 84 via conduit 81 into container 82.

At this point the solution enters module 10 via inlets 41, 42 and 43. When module 10 contains too much solution the excess solution will be removed by overflow conduit 51, drain overflow 84 and conduit 81 and flow into reservoir 82. The solution level of reservoir 82 is monitored by sensor 212. Sensor 212 is connected to control logic 67 via line 213. When sensor 212 senses the presence of solution in reservoir 82, a signal is transmitted to logic 67 via line 213 and logic 67 enables pump 214. Thereupon, pump 214 pumps solution into manifold 64. When sensor 212 does not sense the presence of solution, pump 214 is disabled by the signal transmitted via line 213 and logic 67. When solution in reservoir 82 reaches overflow 215 the solution will be transmitted through conduit 216 into reservoir 217. The remaining solution will circulate through channel 25 and reach outlet lines 44, 45, 46 and 47. Thereupon, the solution will pass from outlet lines 44, 45, 46 and 47 to sump 226. The solution will exit sump 226 via conduit line 85 and enter recirculation pump 80. The photographic solution contained in the apparatus of this invention, when exposed to the photosensitive material, will reach a seasoned state more rapidly than prior art systems, because the volume of the photographic processing solution is less.

Figure 6:
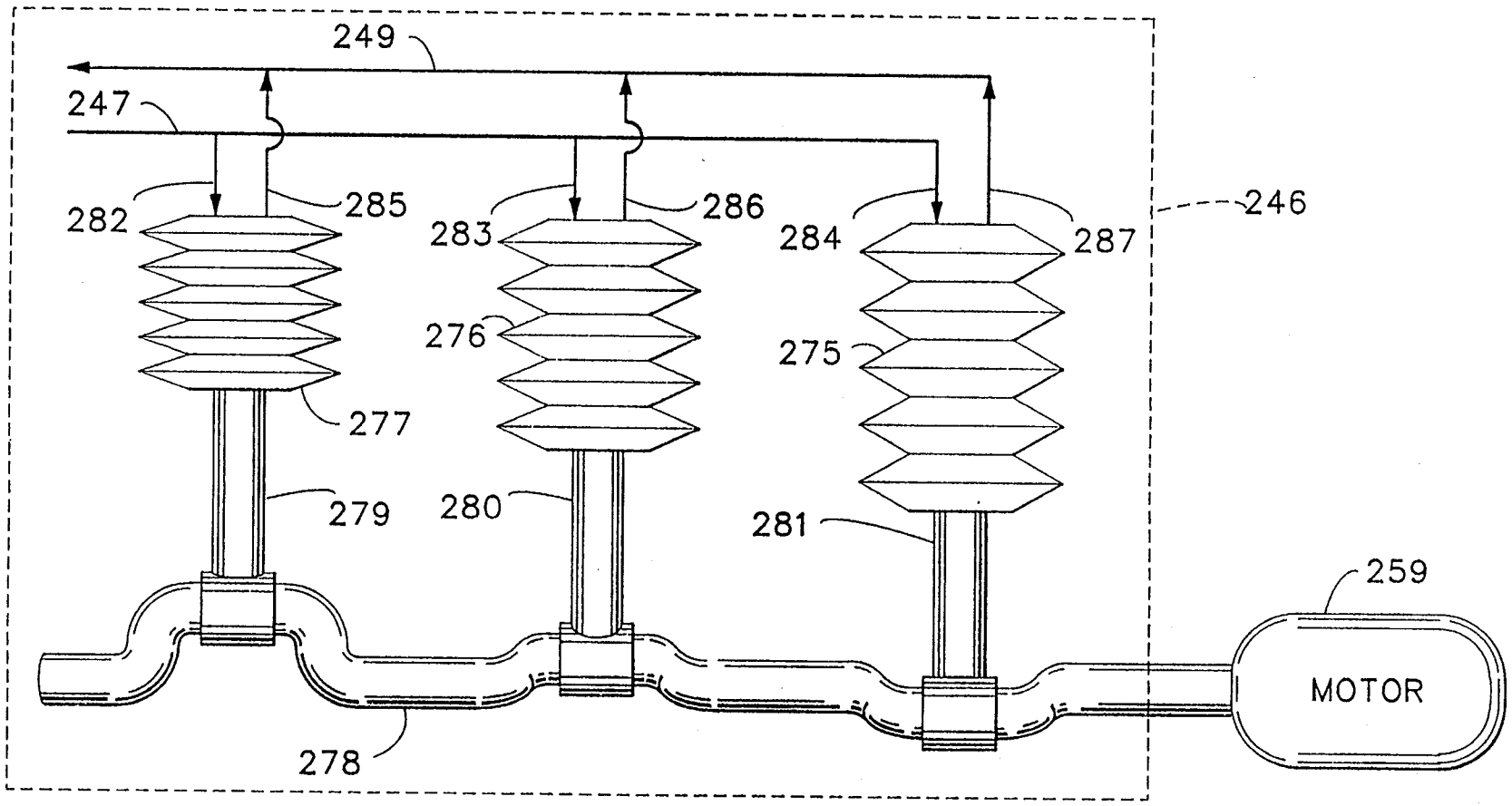
FIG. 6 is a drawing of pump 246.

FIG. 6 is a drawing of pump 246. Pump 246 comprises' bellows 275, 276 and 277, crank shaft 278 and connecting rods 279, 280 and 281. Shaft 278 is respectively connected to bellows 275, 276 and 277 by connecting rods 281, 280 and 279. Connecting rods 279, 280 and 281 are interconnected to shaft 278, 120° out of rotational phase with each other.

One skilled in the art would realize that other pumps or devices may be used in place of or in combination with bellows pumps, i.e., piston pumps, and peristaltic pumps, etc.

Also the rotational speed of a single bellows pump may be varied during each rotational cycle to smooth out or reduce the pulsing deliver of the replenished solution.

When pump drive motor 259 is energized shaft 278 will rotate and connecting rods 279, 280 and 281 will alternately compress and expand bellows pumps 275, 276 and 277. Thereupon drawing replenishment solution through conduit 247 and forcing replenishment solution out through conduit 249. Pump inlets 282, 283 and 284 are connected to replenishment vessel 245 (FIG. 5) via conduit 247. Outlets 285, 286 and 287 are connected to metering vessel 248 via conduit 249.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

Parts List

4 conduit
7 wire
8 sensor
9 backing plate
10 processing module
11 container
12 transport roller assembly
13 transport roller assembly
15 transport roller assembly
16 drive
17a–1 nozzles
18 rotating assembly
20 cover
21 photosensitive material
22 roller
23 roller
24 channel section
25 channel
26 bearing bracket
28 intermeshing gears
30 roller
31 roller
32 roller
33 roller
41 port
41a–c inlet port
42 port
42a–c inlet port
43 port
43a–c inlet port
44 port
44a–c port
45 port
45a–c port
46 port
46a–c port
47 port
47a–c port
48a–1 conduit
49a–1 gap
50a–1 conduit
51 overflow conduit
52 sensor
60 recirculation system
61 access hole
62 tension springs
63 conduit
64 manifold
65 filter
66 conduit
67 control logic
68 wire
70 wire
71 wire
80 recirculating pump
81 conduit
82 container
84 drain overflow
85 conduit
86 heat exchanger
100 entrance channel
101 exit channel
130 roller
131 roller
200 textured surface
205 textured surface
210 sensor
211 line
212 sensor
213 line
214 pump
215 overflow
216 conduit
217 reservoir
226 sump
235 solution level
245 metering vessel
246 pump
247 conduit
248 metering vessel
249 conduit
250 conduit
251 conduit
252 valve
253 conduit
254 microprocessor
255 motor drive
257 wire
258 wire
259 motor
260 wire
261 wire
268 sensor
269 sensor
270 sensor
271 sensor
272 sensor
275 bellows
276 bellows
277 bellows
278 crank shaft
279 connecting rods
280 connecting rods
281 connecting rods
282 pump inlets
283 pump inlets
284 pump inlets
285 outlets
286 outlets 287 outlets

What is claimed is:

1. An apparatus for processing photosensitive materials, the apparatus comprising:

a processing module comprising a container and at least one processing assembly placed in said container, said at least one processing assembly forming a channel through which a processing solution flows, said channel having an entrance and an exit;

transport means for transporting the photosensitive material from the channel entrance through the said channel to the channel exit, said at least one processing assembly substantially filling said container and being dimensioned so that a small volume is provided for holding or moving processing solution through said processing module;

means for recirculating the processing solution through the small volume provided in said processing channel, said processing channel and means for recirculating the processing solution being dimension so that a small volume for holding processing solution is provided; and means for replenishing the processing solution in a precisely controlled volume so as to provide a substantially uniform amount of processing solution.

2. The apparatus claimed in claim 1, wherein said replenishing means comprises:

one or more pumps that output a uniform amount of processing solution.

3. The apparatus claimed in claim 1, wherein said replenishing means comprises:

two or more pumps that are connected out of phase.

4. The apparatus claimed in claim 3, wherein said pumps are selected from the group consisting of bellows pumps, piston pumps and peristaltic pumps.

5. The apparatus claimed in claim 1, wherein said replenishing means comprises:

a pump that has a uniform delivery output that is controlled by adjusting the input cycle of said pump.

6. The apparatus claimed in claim 1, further including:

calibration means coupled to said replenishment means for changing and verifying the rate of deliver of replenished processing solution.

7. The apparatus claimed in claim 6, wherein said calibration means comprises:

a metering vessel.

8. The apparatus claimed in claim 6, further including:

a microprocessor coupled to said metering vessel to automatically measure the rate of delivery of replenished processing solution.

9. The apparatus claimed in claim 6, further including:

a microprocessor coupled to said metering vessel and said replenishing means to automatically adjust and control the rate of delivery of replenished processing solution.

10. The apparatus claimed in claim 1, further including:

calibration means coupled to said replenishment means for verifying and controlling the rate of delivery of replenished processing solution, while the processing apparatus is processing photosensitive materials.

11. The apparatus claimed in claim 1, further including:

calibration means coupled to said replenishment means for automatically verifying and changing the rate of delivery of replenished processing solution, while the processing apparatus is processing photosensitive materials.

12. An apparatus for processing photosensitive materials, the apparatus comprising:

a processing module comprising a container, at least one processing assembly placed in said container and at least one transport assembly disposed adjacent said at least one processing assembly, said at least one processing assembly and said at least one transport assembly forming a substantially continuous channel through which a processing solution flows, said at least one processing assembly and said at least one transport assembly substantially filling said container and being dimensioned so that a small volume is provided for holding or moving processing solution and photosensitive materials through said processing module, at least one discharge opening is provided one processing assembly for introducing processing solution to said channel;

means for circulating the processing solution from said small volume provided in said module directly through said at least one discharge opening; and means for replenishing the processing solution in a precisely controlled volume so as to provide a substantially uniform amount of processing solution.

13. An apparatus for processing photosensitive materials, said apparatus comprising:

a processing module comprising a container and at least one processing assembly placed in said container, said at least one processing assembly forming a channel through which a processing solution flows, said channel having an entrance and an exit and at least one discharge opening is provided in said at least one processing assembly for introducing processing solution to said channel;

transport means for transporting the photosensitive material from said channel entrance through said channel to the channel exit, said transport means being disposed adjacent said at least one processing assembly and forming a portion of said channel, said container, said transport means and said at least one processing assembly are dimensioned so that a small volume is provided for holding and moving processing solution and photosensitive material through the processing module;

means for circulating the processing solution through the small volume provided in said processing module; and means for replenishing the processing solution in a precisely controlled volume so as to provide a substantially uniform amount of processing solution.

14. An apparatus for processing photosensitive materials, said apparatus comprising:

a processing module comprising a container, at least one processing assembly placed in said container and at least one transport assembly disposed adjacent said at least one processing assembly, said at least one processing assembly and said at least one transport assembly form a substantially continuous channel through which a processing solution flows, said at least one processing assembly and said at least one transport assembly substantially filling said container and being dimensioned so that a small volume is provided for holding and moving processing solution and photosensitive materials through said processing module, wherein at least one transport assembly is provided with at least one discharge opening for introducing processing solution through said channel;

means for circulating the processing solution through a small volume provided in said module; and means for replenishing the processing solution in a precisely controlled volume so as to provide a substantially uniform amount of processing solution.

15. An apparatus for processing photosensitive materials, said apparatus comprising:

a processing module comprising a container and at least one processing assembly placed in said container, said container and said at least one processing assembly form a substantially continuous channel through which a processing solution flows, said channel having an entrance and an exit, said at least one processing assembly having a discharge opening for delivering processing solution through said channel, said at least one discharge opening provided in said at least one processing assembly for introducing processing solution into said channel, said at least one processed assembly and container are dimensioned so that a small volume is provided for holding and moving processing solution and photosensitive material through said processing module;

means for circulating the processing solution directly from said small volume provided in said processing module through said discharge opening; and means for replenishing the processing solution in a precisely controlled volume so as to provide a substantially uniform amount of processing solution.

* * * * *